US011975803B2

(12) United States Patent
van Kuilenburg et al.

(10) Patent No.: US 11,975,803 B2
(45) Date of Patent: May 7, 2024

(54) HOIST APPARATUS FOR MOBILE OFFSHORE PLATFORM

(71) Applicant: Noble Rig Holdings Limited, Sugar Land, TX (US)

(72) Inventors: Robert van Kuilenburg, Sugar Land, TX (US); Hans H. J. Deul, Richmond, TX (US)

(73) Assignee: Noble Rig Holdings Limited, Sugar Land, TX (US)

( * ) Notice: Subject to any disclaimer, the term of this patent is extended or adjusted under 35 U.S.C. 154(b) by 0 days.

(21) Appl. No.: 17/881,898

(22) Filed: Aug. 5, 2022

(65) Prior Publication Data

US 2022/0371697 A1 Nov. 24, 2022

Related U.S. Application Data

(63) Continuation of application No. PCT/US2021/016967, filed on Feb. 6, 2021.

(60) Provisional application No. 62/970,768, filed on Feb. 6, 2020.

(51) Int. Cl.
*B63B 27/10* (2006.01)
*B63B 27/16* (2006.01)
*B63B 35/44* (2006.01)

(52) U.S. Cl.
CPC ..... *B63B 27/10* (2013.01); *B63B 27/16* (2013.01); *B63B 35/4413* (2013.01)

(58) Field of Classification Search
CPC ..... B63B 27/10; B63B 27/16; B63B 35/4413; E21B 15/02; B66C 23/52
See application file for complete search history.

(56) References Cited

U.S. PATENT DOCUMENTS 2,889,898 A * 6/1959 Woolslayer ..... B66C 23/52 212/262
4,448,396 A 5/1984 Delago
(Continued)

FOREIGN PATENT DOCUMENTS

DE 927470 C 5/1955
JP S5174970 U 6/1976
(Continued)

OTHER PUBLICATIONS

International Search Report and Written Opinion of the International Search Authority, International Application No. PCT/US2021/016967 dated Jun. 1, 2021.
(Continued)

*Primary Examiner* — Lynn E Schwenning
(74) *Attorney, Agent, or Firm* — Richard A. Fagin

(57) ABSTRACT

A system for lifting loads from a mobile offshore platform includes a boom pivotally at one longitudinal end mounted to the platform. A boom extension line is coupled at one end to the boom to cause rotational movement thereof about the pivotally mounted end of the boom. Another end of the boom extension line is either (i) coupled to a movable subplatform on the platform or (ii) supported by a device coupled to the movable subplatform. Movement of the subplatform causes change in effective length of the boom extension line so as to move the boom between an extended position and a retracted position.

17 Claims, 5 Drawing Sheets

(56) References Cited

U.S. PATENT DOCUMENTS

| | | | | |
|---|---|---|---|---|
| 5,975,807 | A * | 11/1999 | Khachaturian | E02B 17/00 405/209 |
| 6,901,998 | B1 | 6/2005 | Roodenberg et al. | |
| 9,284,706 | B2 | 3/2016 | Roodenberg et al. | |
| 9,802,796 | B2 * | 10/2017 | Li | B66C 23/18 |
| 2010/0102017 | A1 | 4/2010 | Roodenburg et al. | |
| 2015/0151953 | A1 | 6/2015 | Weterings et al. | |
| 2018/0099843 | A1 | 4/2018 | Maini et al. | |

FOREIGN PATENT DOCUMENTS

| | | | |
|---|---|---|---|
| JP | S54172463 | U | 12/1979 |
| JP | S6374894 | A | 4/1988 |
| NL | 7710416 | A | 4/1978 |
| WO | 2012/144952 | A1 | 10/2012 |

OTHER PUBLICATIONS

Extended European Search Report dated Feb. 22, 2024, for European Patent Application No. 21751456.1.
Australian Examination Report dated Aug. 24, 2023, Australian Patent Application No. 2021216432.

* cited by examiner

HOIST APPARATUS FOR MOBILE OFFSHORE PLATFORM

CROSS REFERENCE TO RELATED APPLICATIONS

Continuation of International Application No. PCT/US2021/016967 filed on Feb. 6, 2021. Priority is claimed from U.S. Provisional Application No. 62/970,768 filed in Feb. 6, 2020. Both the foregoing applications are incorporated herein by reference in their entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of marine sub-bottom, e.g., petroleum well operations. More specifically, the disclosure relates to hoisting apparatus used in connection with mobile offshore platforms for lifting and moving devices on wells and/or platforms to be serviced in abandonment operations.

Marine sub-bottom well operations include plugging and abandonment of wells, and removal of structures disposed above the water surface, and/or located on the water bottom, associated with fluid production after the economic life of the associated wells and equipment is exhausted. For example, a bottom supported or floating production platform may comprise petroleum processing equipment such as water extractors, gas separators, compressors and storage tanks. Some such platforms may also comprise personnel quarters and related facilities. When wells connected (directly or by pipeline) to such a platform no longer produce economically useful amounts of petroleum, such wells may be plugged. When the processing equipment and/or personnel quarters on such platforms are no longer economically useful to maintain, such equipment may be removed from the platforms. Supporting steel structures, where present, need to be removed.

One apparatus used to remove such equipment from a production platform is a mobile offshore drilling unit (MODU). FIG. 1 shows use of a MODU 10 in such operations. The MODU 10 may be moved proximate a platform 12, such as a bottom supported jacket platform, for removal of equipment 13 from above the water line 11. The MODU 10 may be operated by lowering jacking legs 10C to the water bottom 11A and continuing jacking to lift the hull and attached cantilever/drilling system 10A to a selected elevation above the platform 12. The cantilever/drilling system 10A comprises equipment (not shown separately) that can lift devices 13 from the platform 12 and move them laterally, such as by skidding the cantilever. Such operation can be inefficient and costly. Moreover, mobilizing specialized lifting vessels to perform these operations can be even more costly. Because plugging and abandonment operations are only a cost item for the platform operator, there is substantive incentive to minimize such costs.

SUMMARY

One aspect of the present disclosure is a system for lifting loads from a mobile offshore platform. A system according to this aspect includes a boom pivotally at one longitudinal end mounted to the platform. A boom extension line is coupled at one end to the boom to cause rotational movement thereof about the pivotally mounted end of the boom. Another end of the boom extension line is either (i) coupled to a movably mounted subplatform disposed on the platform or (ii) supported by a supporting device coupled to the movable subplatform. Movement of the subplatform or the supporting device causes change in effective length of the boom extension line so as to move the boom between an extended position and a retracted position.

In some embodiments, the subplatform comprises a laterally extensible cantilever having a drilling hoist system disposed thereon.

Some embodiments further comprise a load lift line extending from a winch disposed on the platform, the load lift line extending though at least one sheave mounted on the boom.

In some embodiments, the load lift line is connected to a drilling unit hoisting system disposed on the movably mounted subplatform.

In some embodiments, the sheave is mounted proximate an end of the boom opposed to the pivotally mounted end.

In some embodiments, the boom is pivotally mounted to the movably mounted subplatform.

In some embodiments, the boom is mounted to the platform apart from the movably mounted subplatform.

In some embodiments, the other end of the boom extension line is coupled to the movably mounted subplatform.

In some embodiments, the other end of the boom is coupled to the platform apart from the movably mounted subplatform.

In some embodiments, the boom comprises an A shaped frame pivotally coupled to the platform in two places.

In some embodiments, the supporting device comprises a sheave coupled to the platform through a variable length device.

In some embodiments, the variable length device comprises a winch and cable.

A method for lifting loads from a mobile offshore platform according to another aspect of the present disclosure includes operating a load lifting line extending from a boom pivotally coupled at one longitudinal end to the platform. The method includes operating a boom extension line coupled at one end to the boom so as to cause rotational movement of the boom about the pivotally coupled end of the boom by changing an effective length of the boom extension line. The changing effective length comprises either (i) moving a subplatform movably mounted on the mobile offshore platform wherein another end of the boom extension line is coupled to the subplatform or (ii) moving the boom extension line through a supporting device coupled to the movable subplatform, wherein movement of the subplatform of the supporting device causes change in effective length of the boom extension line so as to move the boom between an extended position and a retracted position.

In some embodiments, the movable subplatform comprises a laterally extensible cantilever having a drilling hoist system disposed thereon.

In some embodiments, the operating a load lift line comprises operating a winch disposed on the mobile offshore platform.

In some embodiments, the winch forms part of a drilling unit hoisting system disposed on the movable subplatform.

In some embodiments, the boom is pivotally mounted to the movably mounted subplatform.

In some embodiments, the boom is mounted to the platform apart from the movably mounted subplatform.

Other aspects and advantages will be apparent from the description and claims that follow.

DETAILED DESCRIPTION

Figure 2:
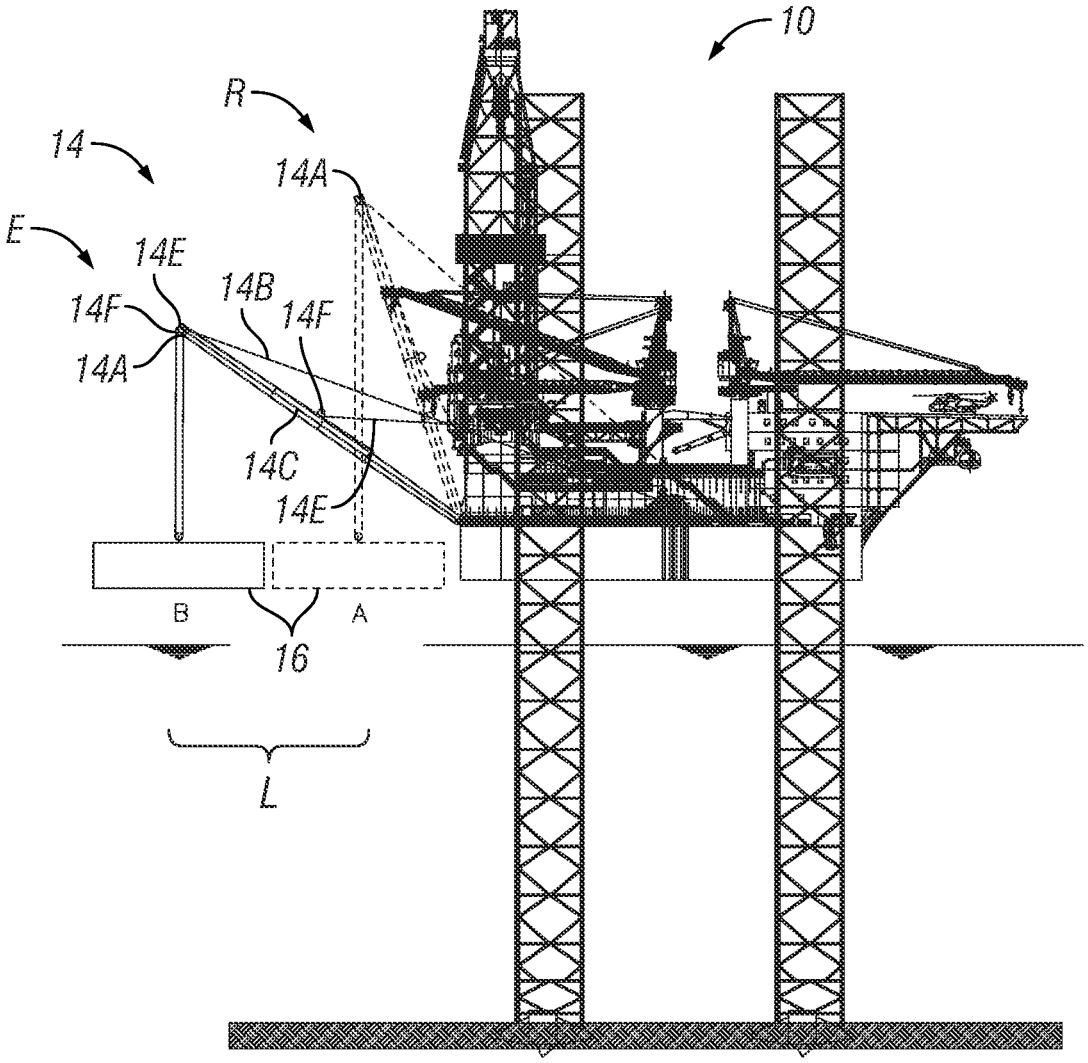
FIG. 2 through 7 show various views and example embodiments of a mobile offshore drilling unit (MODU) including a hoisting apparatus according to the present disclosure, using a cantilever on the MODU as a mechanism to raise and lower the lifting apparatus boom.

FIG. 2 shows a MODU 10 comprising a hoisting apparatus 14, e.g., a crane, according to various aspects of the present disclosure. FIG. 2 shows the hoisting apparatus 14 in general terms, wherein more detail as to certain aspects of the disclosure will be explained with reference to FIGS. 3 through 10. The hoisting apparatus 14 may comprise a boom 14C having one or more sheaves 14A disposed at a selected position, which may be proximate the free longitudinal end (the end not pivotally coupled to the MODU 10) 14G of the boom 14C. The one or more sheaves at the illustrated location, i.e., the one or more sheaves 14A, are used for load lifting only and in this embodiment are not used to raise or lower the boom 14C. "Raise or lower" in the present context means changing an angle of the boom 14C with reference to the MODU or other fixed frame of reference. The boom 14C may be pivotally coupled, e.g., at a pivot point P, to certain parts of the MODU 10 at the other longitudinal end of the boom 14C in a manner to be explained in more detail below with reference to FIGS. 3 through 7. The boom 14C in some embodiments may be a single beam, pole or frame. In some embodiments, the boom 14C may be in the form of a two or more leg "A" frame having laterally spaced apart pivot points coupled to the MODU 10, wherein the legs couple to each other at the free end of the boom 14C. Thus, in the view shown in FIG. 2, the legs of such an "A" frame will be in the same plane and would not be separately observable. Each such leg may be coupled pivotally to the MODU 10 at a corresponding pivot point. An "A" frame structure for the boom 14C, if used, may provide the benefit of reduced cost while maintaining substantial lateral rigidity of the hoisting apparatus 14 overall. "Lateral" rigidity in the present context means resistance to movement of the boom 14C in a plane normal (perpendicular) to the view of FIG. 2.

Figure 1:
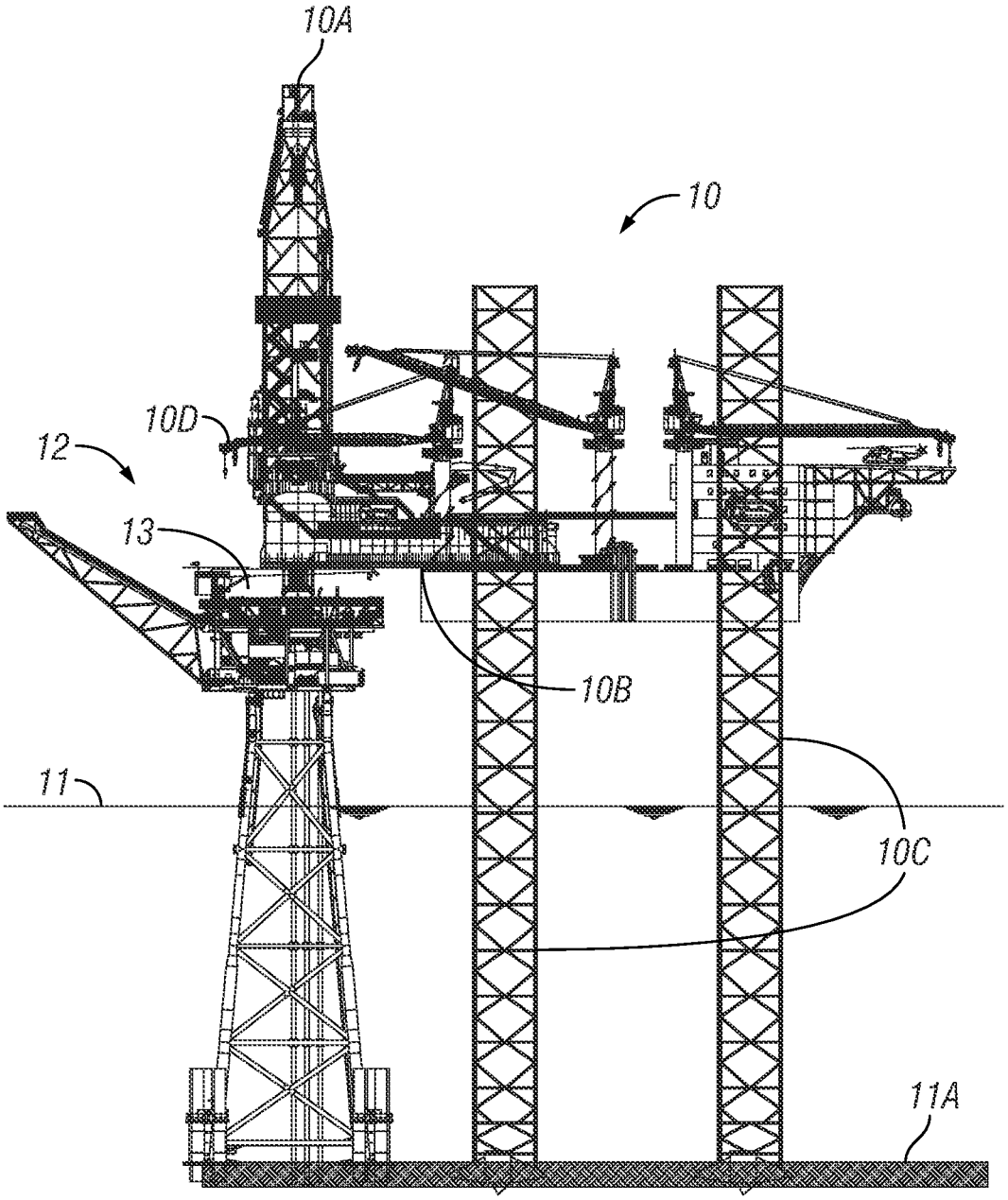
FIG. 1 (Prior Art)
FIG. 1 shows an example of using a mobile offshore drilling unit (MODU) for well abandonment and known in the art prior to the present disclosure.

FIG. 2 also shows the boom 14C in a laterally extended (and vertically lowered) position at E, and in the same drawing in ghost form in the laterally retracted (and vertically raised) position at R. A load lifting line 14E may pass through suitable sheave(s) 14F on or along the boom 14C and through the one or more sheaves 14A on the end of the boom 14. The load lifting line 14E may be used to raise and lower a load 16 (shown in both suspended from the load lifting line 14E wherein the boom 14C is in the extended position E and the retracted position R in FIG. 2) coupled to the end of the load lifting line 14E. Means for operating the load lifting line 14E in some embodiments will be further explained with reference to FIGS. 8 through 10. The load 16 may be equipment (e.g., as shown at 13 in FIG. 1) disposed on the platform (12 in FIG. 1).

It will be appreciated that in some embodiments, the boom 14C may have structure to enable lengthening and shortening, that is, to change its longitudinal dimension between the sheave(s) 14A and the pivot point P. However, having such structure is not a limitation on the scope of the present disclosure.

A boom extension line 14B may be coupled at one longitudinal end to a selected point along the boom 14C and may be operated in order to move the boom 14C between an extended position E and a retracted position R. The boom extension line 14B may be coupled to the boom 14C, e.g., to the free longitudinal end 14G of the boom 14C for maximum leverage. The boom extension line 14B, in some embodiments, may be operated by means as will be explained with reference to FIGS. 3 through 7. Moving the boom 14C between the retracted position R and the extended position E changes the effective length of the boom 14C with reference to the horizontal plane, and thereby enables lateral movement of the load 16 along a designed or predetermined distance L with reference to the MODU 10. The predetermined distance L depends on the length of the boom 14C, the attachment point of the boom extension line 14B, the capability of the boom extension line 14B to change length and the resulting amount of angular displacement of the boom 14C between the retracted position R and the extended position E.

Figure 3:
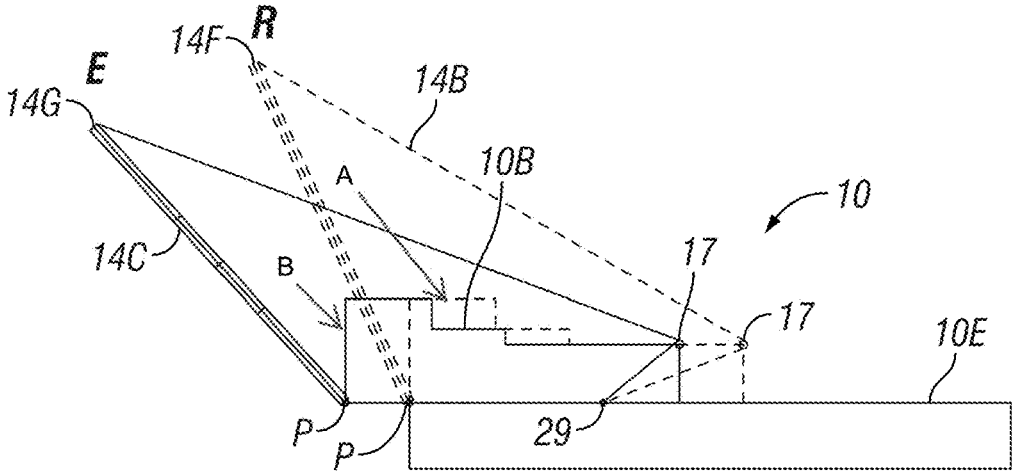

Various implementations of devices to raise and lower the boom 14C may be better understood with reference to FIGS. 3 through 8. In FIG. 3, the boom extension line 14B may extend through a sheave 17, and at its other longitudinal end may be coupled to an attachment point 29. In the present example embodiment, the attachment point P may be at a chosen place on the main deck 10E of the MODU 10. Thus, the attachment point 29 is fixed with reference to the main deck 10E while the cantilever 10B may move with reference to the main deck 10E. Such attachment of the boom extension line 14B results in a change in the effective length of the boom extension line 14B between the attachment point 29 and the free end of the boom 14C when the cantilever 10B moves with respect to the main deck 10E. FIG. 3 shows in ghost form two possible positions of the cantilever 10B, a retracted position A, which may be toward the center of the MODU 10, and an extended position B in the opposite direction. Movement of the cantilever 10B from position B to position A will cause the boom 14C to move from the extended position E to the retracted position R. As may be observed in FIG. 3, the boom 14C not only moves horizontally with the movement of the cantilever 10B but also rotates about the pivotal connection P (explained with reference to FIG. 2) of the boom 14C to the cantilever 10B when the cantilever 10B moves horizontally. Such rotation about the pivotal connection P is caused by the boom extension line 14B running over the sheave 17 and being connected to the main deck 10E at the attachment point 29. Thus, movement of the cantilever 10B with reference to the deck 10E of the MODU 10 will correspondingly change the distance between the sheave 17 and the attachment point 29 on the deck 10E. Because the boom extension line 14B may have a fixed length, the distance between the sheave 17 and the end of the boom 14C must change as well. This will cause the boom 14C to rotate in the indicated direction (between positions E and R) when the cantilever 10B moves. In the embodiment shown in FIG. 3, such movement of the boom 14C from the retracted position R to the extended position E may be effected without the use of a winch or other spooling device to change the effective length of the boom extension line 14B. Because the boom 14C is pivotally coupled to the cantilever 10B, movement of the cantilever 10B in the horizontal plane complements movement of the free longitudinal end 14G of the boom 14C for larger total lateral movement of the load (see 16 in FIG. 2) than would be possible with only pivoting movement, i.e., from the retracted position R to the extended position E, of the boom 14C alone. In embodiments such as shown in FIG. 3, it is also possible to move the boom 14C from the extended position E to the retracted position R without having a winch or other device to spool (change the overall length of) the boom extension line 14B.

Figure 4:
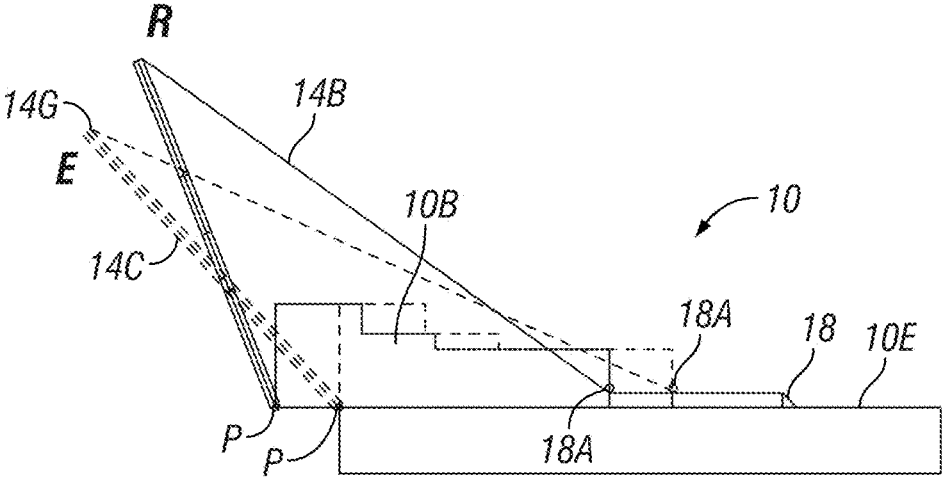

In FIG. 4, the attachment point, shown at 18, for the boom extension line 14B, may be on the hull or other stationary part of the MODU 10 that does not move with the cantilever 10B. The boom extension line 14B may pass through one or more sheaves 18A which are coupled to the cantilever 10B such that motion of the cantilever 10B causes corresponding motion of the one or more sheaves 18A with reference to the deck 10E. Such corresponding motion of the one or more sheaves 18A causes a corresponding change in the geometry of the boom extension line 14B, such that its hypotenuse (effective) length between the attachment point 18 and the free end 14G of the boom 14C changes. Such effective length change operates to move the boom 14C between the extended position E and the retracted position R.

Figure 5:
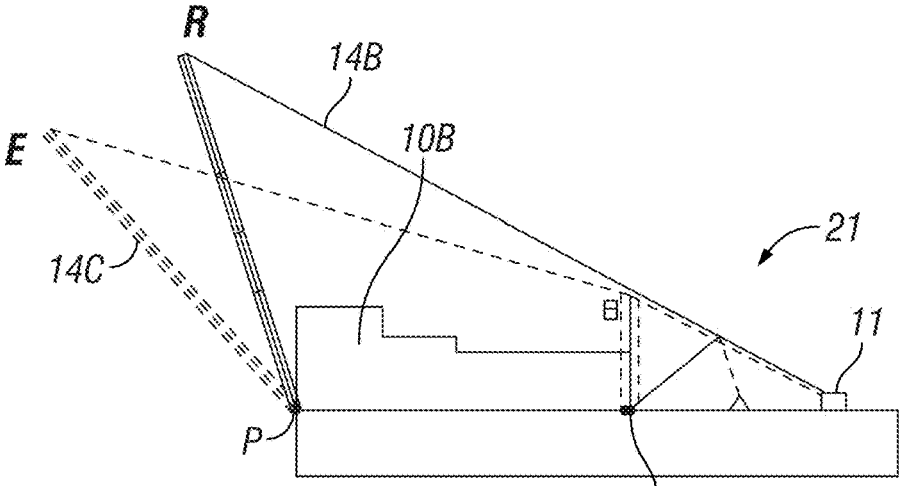

FIG. 5 shows another example embodiment, wherein the attachment point 19 may be disposed either on the cantilever 10B or on the main deck 10E of the MODU 10. Having the attachment point 19 as shown allows a movable subframe 21 to rotate. The boom extension line 14B in this embodiment can be one or more fixed cables, rods or any other device that can transmit tensional forces between the free end 14G of the boom 14C and the movable subframe 21. This may be advantageous because it limits the length of wire or cable that needs to be stored on a winch 11. The winch or other device 11 operable to change length (e.g., a hydraulic cylinder) can rotate the movable subframe 21, which in turn will change the effective length of the boom extension line 14B. Such length change will rotate the boom 14C about the pivot point P. Winch 11 can be located on the deck 10E or on the cantilever 10B. In FIG. 5, movement of the subframe 21 using a fixed length boom extension line 14B causes moving the boom 14C between the extended position E and the retracted position R without movement of the cantilever 10B. It should be understood that additional movement in the horizontal plane of the free end 14G of the boom 14C, and thus the load (16 in FIG. 2) may be obtained by moving the cantilever 10B as explained with reference to FIGS. 3 and 4. A possible advantage of the embodiment of FIG. 5 is the mechanical leverage provided by the structure with reference to the boom extension line 14B. Thus, moving the boom 14C from the retracted position R to the extended position E only requires the winch to have a braking action, and reduces the required lift capacity of the winch 11. The foregoing lowers the cost of the winch 11 used to operate the boom extension line 14B.

Figure 6:
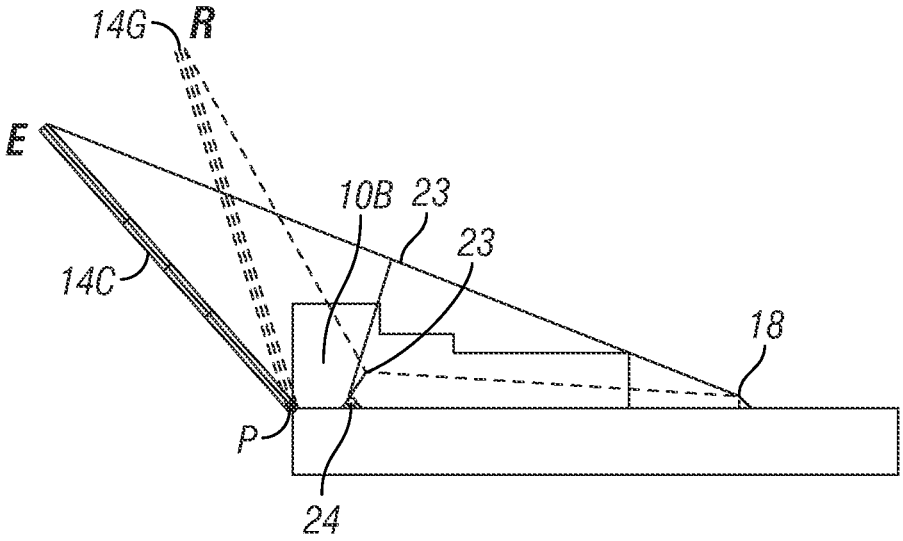

FIG. 6 shows another example embodiment having the attachment point 18 for the boom extension line 14B be on one of the non-movable parts of the MODU, such as the main deck 10E similar to what is shown in FIG. 4. The boom extension line 14B may pass through one or move sheaves 23, which may be coupled to part of the MODU 10 (e.g., to the deck 10E or to the cantilever 10B) through a winch and cable 24 or other variable length device to change effective length of the coupling between the sheave(s) 23 and the MODU 10. Changing such effective length enables moving the sheave(s) 23 from an extended position B to a retracted position A. By such movement of the sheave(s) 23, the effective length of the boom extension line 14B between the attachment point 18 and the free end 14G may be changed from the hypotenuse (a shortest possible path) to a longer path. Changing the path length while keeping the actual length of the boom extension line 14B fixed has the effect of shortening the effective length of the boom extension line 14B, thus moving the boom 14C between the retracted position R and the extended position E. A possible advantage of the embodiment of FIG. 5 is the mechanical leverage provided by the structure with reference to the boom extension line 14B. Thus, moving the boom 14C from the retracted position R to the extended position E only requires the winch to have a braking action, and reduces the required lift capacity of the winch 24. The foregoing lowers the cost of the winch 24 used to operate the boom extension line 14B.

Figure 7:
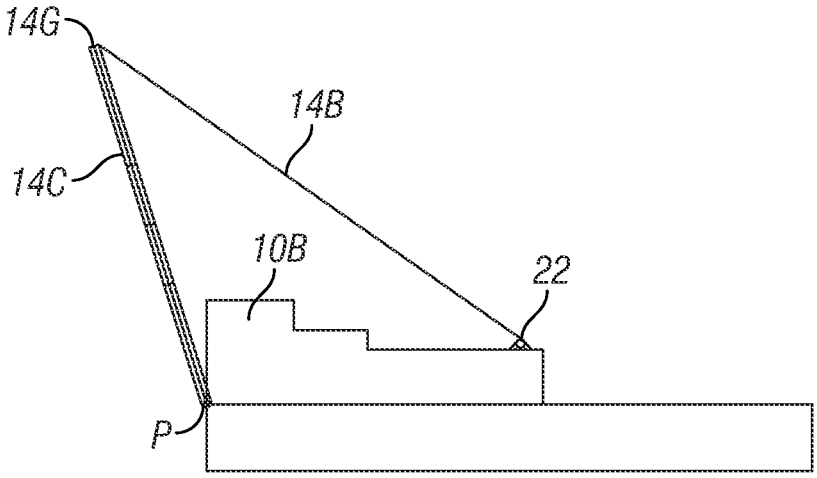

Another example embodiment is shown in FIG. 7. In FIG. 7, the boom extension line 14B may be extended and retracted by a winch 22 disposed on one side of the cantilever 10B. The embodiment of FIG. 7 enables movement of the boom 14C between the extended and retracted positions as in other embodiments, as well as lateral movement of the boom 14C corresponding to movement of the cantilever 10B. A consideration in such embodiments compared to the other described embodiments is that the boom extension line 14B, due to the large forces applied to it, typically must run through many sheaves, therefore requiring a very long line and correspondingly large line capacity winch.

As may be desirable, embodiments such as shown in FIGS. 3 through 7 enable movement of the cantilever 10B to complement movement of the boom 14C for larger lateral movement of the load (see FIG. 1) than would be possible with pivoting movement of the boom 14C alone. In such embodiments, it is possible to obtain a required amount of effective lateral movement of the boom 14C, e.g., such as shown at L in FIG. 2, without the need to have the boom itself be longitudinally extendable. Thus, in some embodiments, a fixed length boom may be used, thereby saving cost and complexity.

Figure 8:
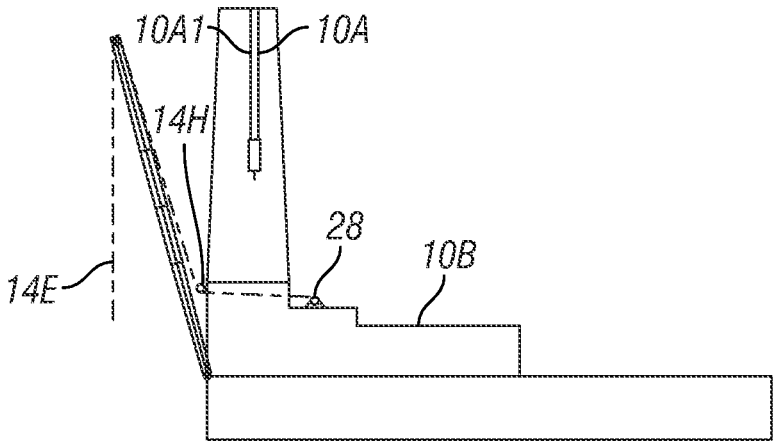
FIGS. 8 through 10 show an example embodiment of a mobile offshore drilling unit according to the present disclosure wherein a hoisting system in the drilling apparatus of the MODU is used as a winch in the disclosed hoisting apparatus to raise and lower a load attached to a hoist line.
Figure 9:
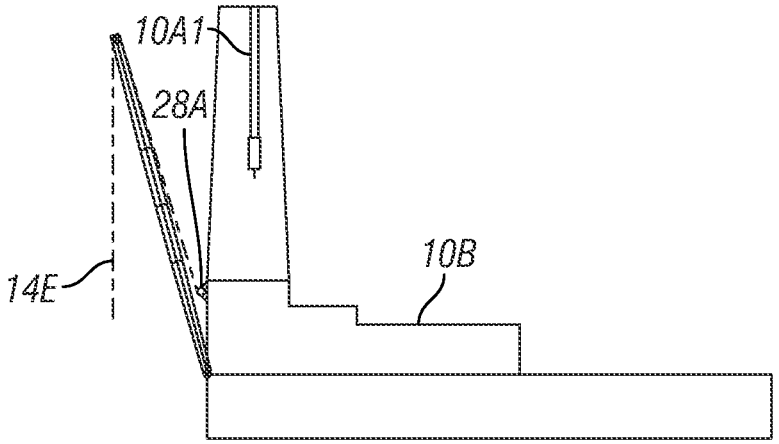
Figure 10:
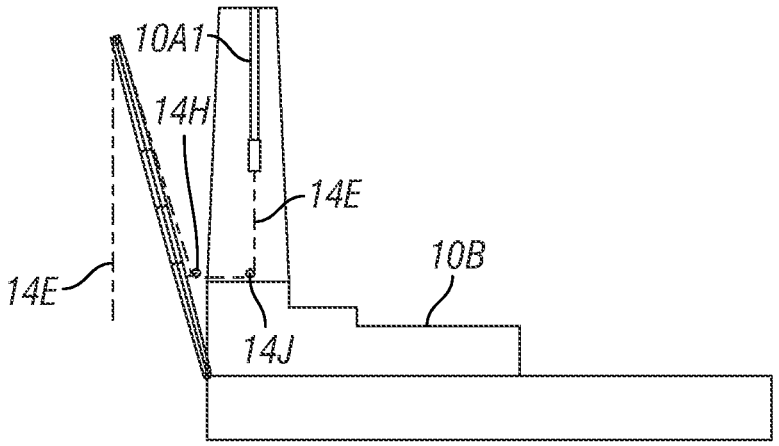

FIGS. 8 through 10 show various implementations of a winch that may be used to operate, i.e., raise (retract) and lower (extend) the load lift line 14E. In FIG. 8, the load lift line 14E may be spooled and unspooled by a winch 28 that may be affixed to the cantilever 10B on the inboard (with reference to the center of the hull of the MODU 10) side thereof. The load lift line 14E may pass through one or more sheaves 14H disposed along the boom 14C. Tension on the load lift line 14E may partially offset load on the boom 14C resulting from the weight thereof. For consistency among the various views in FIGS. 8 through 10, the drilling unit 10A is shown with its associated drilling hoisting apparatus 10A1, e.g., in the form of a top drive raised and lowered by an associated drawworks. It is to be understood that other embodiments may use other drilling hoisting apparatus that do not include a top drive.

FIG. 9 shows an embodiment similar to that shown in FIG. 8, wherein the winch 28A used to operate the load lift line 14E is disposed proximate the outboard side of the cantilever 10B.

FIG. 10 shows another example embodiment, wherein the load lift line 14E is coupled to the hoisting apparatus 10A1 through sheaves 14H, 14J disposed on and/or about the drilling unit 10A. In the embodiment of FIG. 10, the load lift line 14E may be moved by raising and lowering the drilling hoisting apparatus 10A1, thus avoiding the need for a costly additional winch for operating the load lift line 14E.

The embodiments of FIGS. 8 through 10 may have the boom 14C pivotally coupled to the cantilever 10B as in the embodiments of FIGS. 5, 6 and 7 such that lateral movement of the cantilever 10B with reference to the MODU 10 may supplement lateral movement of the free end of the boom 14C (when moved between extended position E and retracted position R) for enhanced lateral translation distance (L in FIG. 2).

In light of the principles and example embodiments described and illustrated herein, it will be recognized that the example embodiments can be modified in arrangement and detail without departing from such principles. The foregoing discussion has focused on specific embodiments, but other configurations are also contemplated. In particular, even though expressions such as in "an embodiment," or the like are used herein, these phrases are meant to generally reference embodiment possibilities, and are not intended to limit the disclosure to particular embodiment configurations. As used herein, these terms may reference the same or different embodiments that are combinable into other embodiments. As a rule, any embodiment referenced herein is freely combinable with any one or more of the other embodiments referenced herein, and any number of features of different embodiments are combinable with one another, unless indicated otherwise. Although only a few examples have been described in detail above, those skilled in the art will readily appreciate that many modifications are possible within the scope of the described examples. Accordingly, all such modifications are intended to be included within the scope of this disclosure as defined in the following claims.

What is claimed is:

1. A system for lifting loads from a mobile offshore platform, comprising:

a boom pivotally at one longitudinal end mounted to the platform;

a boom extension line coupled at one end to the boom to cause rotational movement thereof about the pivotally mounted end of the boom, another end of the boom extension line either (i) coupled to a subplatform movably mounted on the platform or (ii) supported by a supporting device coupled to the subplatform, wherein movement of the subplatform or movement of the supporting device relative to the platform causes change in effective length of the boom extension line so as to move the boom between an extended position and a retracted position.

2. The system of claim 1 wherein the movably mounted subplatform comprises a laterally extensible cantilever having a drilling hoist system disposed thereon.

3. The system of claim 1 further comprising a load lift line extending from a winch disposed on the platform, the load lift line extending though at least one sheave mounted on the boom.

4. The system of claim 3 wherein the load lift line is connected to a drilling unit hoisting system disposed on the movably mounted subplatform.

5. The system of claim 3 wherein the sheave is mounted proximate an end of the boom opposed to the pivotally mounted end.

6. The system of claim 1 wherein the boom is pivotally mounted to the movably mounted subplatform.

7. The system of claim 1 wherein the boom is mounted to the platform apart from the movably mounted subplatform.

8. The system of claim 1 wherein the other end of the boom extension line is coupled to the movably mounted subplatform.

9. The system of claim 1 wherein the other end of the boom is coupled to the platform apart from the movably mounted subplatform.

10. The system of claim 1 wherein the supporting device comprises a sheave coupled to the platform through a variable length device.

11. The system of claim 10 wherein the variable length device comprises a winch and cable.

12. A method for lifting loads from a mobile offshore platform, comprising:

operating a load lifting line extending from a boom pivotally coupled at one longitudinal end to the platform; and operating a boom extension line coupled at one end to the boom so as to cause rotational movement of the boom about the pivotally coupled end of the boom by changing an effective length of the boom extension line, the changing effective length comprising either (i) moving a subplatform movably mounted on the mobile offshore platform wherein another end of the boom extension line is coupled to the subplatform or (ii) moving the boom extension line through a supporting device coupled to the movable subplatform, wherein movement of the subplatform or the supporting device relative to the platform causes change in effective length of the boom extension line so as to move the boom between an extended position and a retracted position.

13. The method of claim 12 wherein the movable subplatform comprises a laterally extensible cantilever having a drilling hoist system disposed thereon.

14. The method of claim 12 wherein the operating a load lift line comprises operating a winch disposed on the mobile offshore platform.

15. The method of claim 12 wherein the winch forms part of a drilling unit hoisting system disposed on the movable subplatform.

16. The method of claim 12 wherein the boom is pivotally mounted to the movably mounted subplatform.

17. The method of claim 12 wherein the boom is mounted to the platform apart from the movably mounted subplatform.

* * * * *